US005426946A

United States Patent [19]

Corduan et al.

[11] Patent Number: 5,426,946

[45] Date of Patent: Jun. 27, 1995

[54] PROCESS AND AN APPARATUS FOR RECOVERING ARGON

[75] Inventors: Horst Corduan, Puchheim; Hartwin Lindner, Geretsried, both of Germany

[73] Assignee: Linde Aktiengesellschaft, Wiesbaden, Germany

[21] Appl. No.: 250,511

[22] Filed: May 27, 1994

[30] Foreign Application Priority Data

May 28, 1993 [DE] Germany ..... 43 17 916.9

[51] Int. Cl.[6] ..... F25J 3/04

[52] U.S. Cl. ..... 62/22; 62/24; 62/36; 62/42

[58] Field of Search ..... 62/22, 24, 32, 36, 42

[56] References Cited

U.S. PATENT DOCUMENTS

| | | | |
|---|---|---|---|
| 4,057,407 | 11/1977 | Bigi | 62/22 |
| 4,836,836 | 6/1989 | Bennett et al. | 62/22 |
| 4,935,044 | 6/1990 | Schoenpflug | 62/22 |
| 4,983,194 | 1/1991 | Hopkins et al. | 62/22 |
| 5,019,145 | 5/1991 | Rhode et al. | 62/22 |
| 5,076,823 | 12/1991 | Hansel et al. | 62/22 |
| 5,159,816 | 11/1992 | Kovak et al. | 62/22 |
| 5,161,380 | 11/1992 | Cheung | 62/22 |
| 5,207,066 | 5/1993 | Bova et al. | 62/22 |
| 5,237,823 | 8/1993 | Cheung et al. | 62/22 X |
| 5,282,365 | 2/1994 | Victor et al. | 62/22 |

*Primary Examiner*—Christopher B. Kilner

*Attorney, Agent, or Firm*—Evenson McKeown Edwards & Lenahan

[57] ABSTRACT

For extracting argon, air is separated in a rectifying system comprising at least one air separating column and one crude argon column. An argon-containing oxygen fraction is taken from the air separating column and is introduced into a crude argon column. In the upper area of the crude argon column, a crude argon fraction is removed and a first reflux liquid is charged. A first residual fraction is taken from the lower area of the crude argon column. The crude argon fraction is introduced into the lower area of a semipure column. In the upper area of the semipure column, an argon fraction is taken which has reduced oxygen, and a second reflux liquid is charged. From the lower area of the semipure column, a second residual fraction is taken which forms the first reflux liquid for the crude argon column.

21 Claims, 1 Drawing Sheet

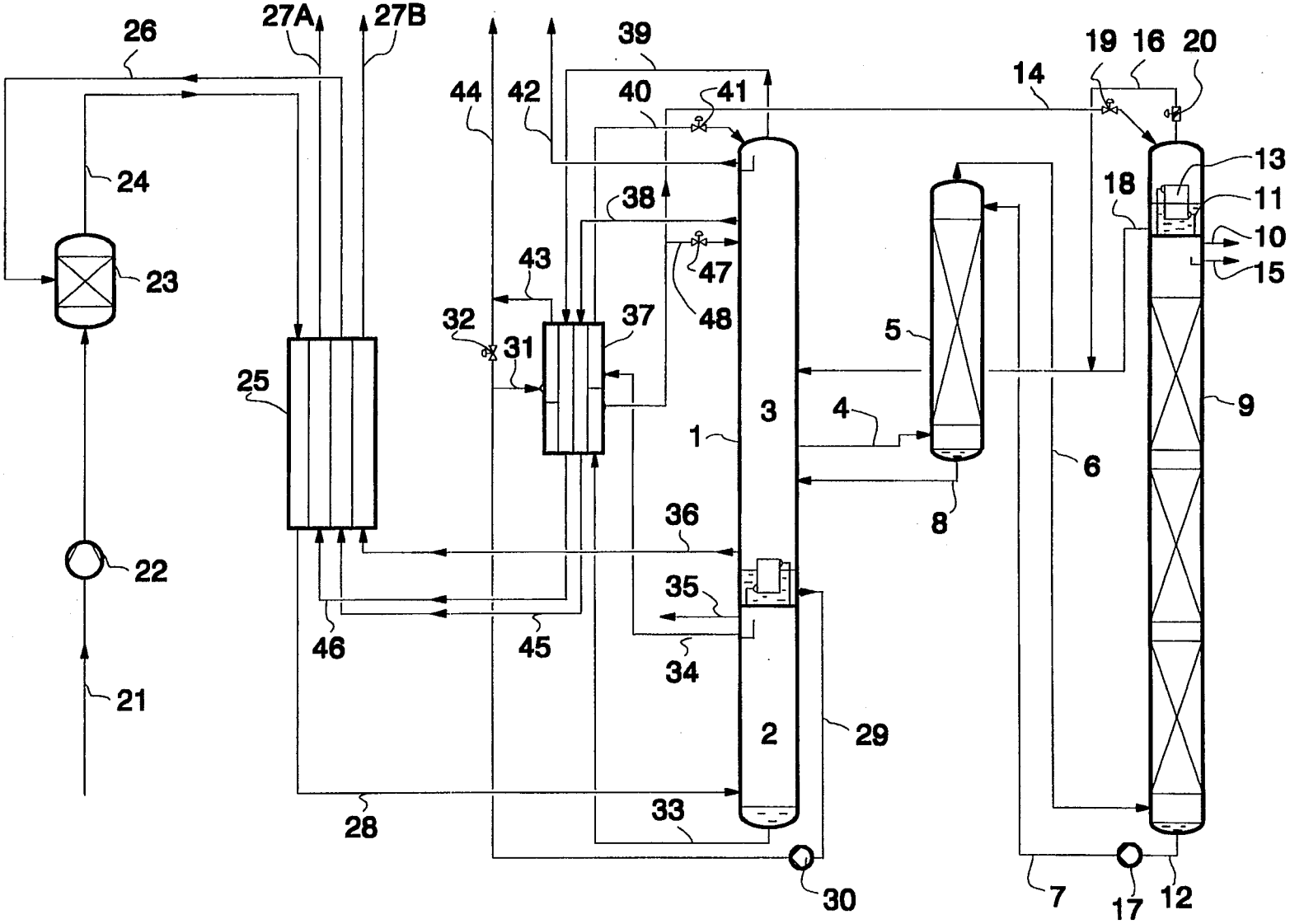
13
11
10
15
9
20
16
19
18
12
17
6
14
7
8
5
4
29
30
3
2
41
47
48
1
36
35
34
33
39
40
38
37
42
43
31
45
44
32
27B
28
27A
46
25
26
24
23
22
21

PROCESS AND AN APPARATUS FOR RECOVERING ARGON

BACKGROUND AND SUMMARY OF THE INVENTION

This invention relates to a process and an apparatus for extracting argon. In the process, air is separated in a rectifying system comprising at least one air separating column and one crude argon column. In this case, an argon-containing oxygen fraction is removed from the air separating column and is introduced into a crude argon column; in the upper area of the crude argon column, a crude argon fraction is removed and a first reflux liquid is charged; and in the lower area of the crude argon column, a first residual fraction is removed.

Processes and systems of this type for obtaining crude argon are generally known from technical references (for example, Hausen/Linde, "Tieftemperaturtechnik"("Low-Temperature Technology", 2nd Edition, Chapter 4.5.4.1; Winnacker/Küchler, "Chemische Technologie"("Chemical Technology"), Volume 2, 3rd Edition, Chapter 5.231; Latimer, "Distillation of Air", Chem. Eng. Progr., 63, Pages 35 to 59). In these processes, following a two-phase air separation, crude argon is obtained in a crude argon column which is connected with the low pressure column of the air separator. Less frequently, the obtaining of crude argon is coupled with a single column for obtaining nitrogen and/or oxygen. The reflux liquid for the crude argon column is produced in a head condenser which is arranged on the upper end of this column.

From European Patent Document EP-B-377 117, a special process of this type is known which provides a particularly high number of theoretical plates in the crude argon column as well as the use of filling bodies or packings in the crude argon column. In this manner, it is possible to reach very low oxygen concentrations in the crude argon product. However, when packings are used, which correspond to a large number of theoretical plates, the overall height of the argon column, including the head condenser, becomes very large so that it may reach or even exceed the height of the air separating column(s) for obtaining oxygen or nitrogen. Apart from the fact that such high columns require additional expenditures for the purpose of stabilization and exact vertical alignment, they may require a high-expenditure design of the insulating casing of the rectifying columns (cold box).

The known processes and apparatuses are therefore not always satisfactory, particularly in the case of a large number of theoretical plates and/or the use of filling bodies or packings in the crude argon column.

An object of the invention is therefore to develop a process and an apparatus of the initially mentioned type which are distinguished by a particularly high economic efficiency, particularly by relatively low apparatus-related expenditures for obtaining crude argon.

This object is achieved according to preferred embodiments in that the crude argon fraction is introduced into the lower area of a semipure column, in which case, in the upper half of the semipure column, an argon fraction is taken which is reduced in oxygen, and a second reflux liquid is charged, and in the lower area of the semipure column, a second residual fraction is taken which forms the first reflux liquid for the crude argon column.

The reflux liquid is therefore formed by the liquid of an additional rectifying column into which, in reverse, the crude argon product is introduced. As a result, a head condenser for the crude argon column will not be necessary.

The product fraction from the crude argon column is further reduced with respect to oxygen in the semipure column. By the use of a semipure column, an essentially oxygen-free argon product may be obtained, in which case the overall height of the crude argon column can be reduced not only by eliminating a head condenser but may also, as a whole, be adapted in a very flexible manner to the circumstances of the whole air separating apparatus. It is intentionally dispensed with achieving the smallest possible oxygen concentration already in the crude argon column. Within the scope of the invention, it was found that the process according to the invention has economical advantages as a result of the reduction of the size of the crude argon column which, in many cases, will outweigh the costs of the additional column.

The oxygen-reduced argon fraction is distilled in a gaseous or liquid manner as a product or intermediate product. It may be further purified, for example, in a pure argon column, particularly by removing nitrogen.

Preferably, the pressure in the lower area of the semipure column is essentially identical with the pressure in the upper area of the pure argon column.

Virtually the same pressure therefore exists in both columns. The requirement of an essentially identical pressure at the head of the crude argon column and at the bottom of the semipure column does not exclude certain differences (for example, caused by the pressure drop along the crude argon line). However, on the whole, these differences should not be so large that special devices must be used in the crude argon line from the head of the crude argon column to the bottom of the semipure column for increasing or reducing the pressure (such as condensers or throttle valves). As required, a pump must be used for delivering the first reflux liquid.

The reflux liquid for the semipure column may basically be produced by the condensation of the corresponding head fraction or be fed from another source.

Preferably, at least a portion of the argon fraction from the upper area of the semipure column is condensed by an indirect heat exchange, at least a portion of the condensate forming the second reflux liquid. For this purpose, as a rule, a head condenser is arranged above the rectifying area of the semipure column.

In this case, it is particularly advantageous, during the indirect heat exchange, for a process flow of the process to be evaporated, preferably a liquid fraction from one of the air separating columns. Therefore, external low temperature for the cooling of the semipure column will not be required.

In the case of a double column air separating process therefore, if the air separating column is constructed in two phases and has a pressure column and a low-pressure column (the argon-containing oxygen fraction is removed from the low-pressure column), the liquid fraction which evaporates against the condensing argon fraction, is preferably formed by oxygen-enriched liquid from the pressure column. Subsequently, the evaporated liquid fraction is fed into the low-pressure column.

This variant of the process according to the invention in which, for example, bottom liquid from the pressure column is used for the condensation of the reduced argon fraction, is particularly favorable with respect to energy. In this case, the evaporation of the liquid fraction preferably takes place essentially at low-pressure column pressure or at a slightly higher pressure.

Preferably, filling bodies and/or ordered packings are used as mass transfer elements in the crude argon and/or semipure column. Because of their particularly low pressure loss, ordered packings are preferred in this case. Also in the other rectifying columns used in the process, for example, in the low-pressure column of a two-phase air separator, filling bodies or packings may be used, particularly ordered packings.

In the case of the process according to the invention, basically any ordered packing may be used. For example, the use of built-in devices is advantageous, as described in WO 93/19335 or WO 93/19336, which are no prior publications.

The combined use of different types of mass transfer elements (conventional rectifying plates, random filler bodies, ordered packings) is also possible in each of the columns used in the process. As a result, for example, the pressure loss along a column can be adapted precisely to the specific requirements of the respective process.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a schematic representation of an air separating system constructed according to a preferred embodiment of the present invention.

DETAILED DESCRIPTION OF THE PREFERRED EMBODIMENTS

In the left part of the drawing figure, an air separating process is outlined for producing oxygen and nitrogen by means of a double column 1 which comprises a pressure column 2 and a low pressure column 3. However, the invention does not depend on the special design of this process step but can also be applied to other versions of this part of the process and of the apparatus, for example, to a system comprising a single column or to different types of the product extraction of nitrogen and oxygen. The very simplified diagram does not show details, such as turbines for the refrigerating relaxation of process flows or the direct feeding of air into the low pressure column.

Referring to the drawing FIGURE, ambient air enters the plant via line 21, is compressed in compressor 22, and purified by purification means 25 (particularly for the removal of water and carbon dioxide). For instance, a molecular sieve station may be used as purification means 23. Pure nitrogen, withdrawn via line 38 from the lower pressure column 3 and warmed in heat exchangers 37 and 25, may be used for regenerating the purification means 23 (see also lines 45, 26). The purified air (line 24) is cooled in heat exchanger 25 nearly to its liquefaction point and introduced via line 28 into high pressure column 2.

Liquid nitrogen 34 from the head of the high pressure column 2 is subcooled in 37 and introduced (40) into low pressure column 3 as reflux after being throttled to low pressure column pressure in valve 41. Optional line 35 may serve for withdrawing high pressure nitrogen as a product and/or for connecting the air separation column 1 to a nitrogen refrigeration cycle. Bottom liquid 33 from the high pressure column 2 is subcooled in heat exchanger 37. A first part (line 48, valve 47) is directly throttled into the low pressure column 3 at an intermediate height. A second part is used as a refrigerant in head condenser 13 (line 14, details above).

Liquid oxygen product may be withdrawn from the bottom of the low pressure column 3 (29), pumped (30) if necessary, and at least partially subcooled in 37 (lines 31, 43) before being withdrawn from the plant via line 44. Control valve 32 controls the part of the liquid oxygen by-passing the subcooler 37. Gaseous oxygen is withdrawn slightly above the bottom liquid of low pressure column 3 via line 36 warmed to nearly ambient temperature in heat exchanger 25 and withdrawn as product via line 2B. 42 is the liquid nitrogen product line. Gaseous nitrogen product (lines 39, 46, 27A) is warmed in heat exchangers 37 and 25.

In the present illustrated embodiment, an argon-containing oxygen flow 4 is extracted at a point with a relatively high argon concentration from the low pressure column 3. Oxygen flow 4 also contains impurities in the form of nitrogen and other air constituents. This oxygen flow 4 is separated in a crude argon column 5 into crude argon 6 and a first residual fraction 8. The first residual fraction 8 is guided back to the low pressure column 3 and is fed back slightly below the extraction point for the argon-containing oxygen flow preferably by means of a pump which is not shown.

According to the invention, crude argon 6 obtained at the head of the crude argon column 5 is subjected in a semipure column 9 to a further rectifying step for the removal of less volatile fractions, particularly of oxygen. For this purpose, the crude argon is fed preferably in a gaseous form into the lower area of this column 9. Argon with reduced oxygen is withdrawn from the upper area of the semipure column 9 in a gaseous 10 and/or liquid 15 form.

Reflux liquid 11 for the semipure column 9 is produced by the condensation of the head fraction by means of an indirect heat exchange 13 against relaxed bottom liquid from the pressure column 2 of the air separator 1. The resulting steam is discharged via line 16 and is introduced at a suitable point into the low pressure column 3.

In contrast, the crude argon column 5 requires no head condenser. Its requirement with respect to reflux liquid 7 is met by bottom liquid 12 which occurs in the semipure column 9. As a rule, a pump 17 must be used in order to overcome the height difference in the line 7.

Throttling valve 19 serves to expand the liquid in line 14 to a lower pressure before introducing it into the head condenser 13 of semipure column 9. Line 16 guides the part of the throttled liquid, which is vaporized in head condenser 13, to the lower pressure column 3. Back-pressure valve 20 avoids that fluid from the low pressure column enters the head condenser 13. Additionally, there may be a small part of liquid fed from the vaporization side of head condenser 13 to low pressure column 3 via line 18.

The rectifying areas illustrated in the drawing in a continuous manner, in reality consist of several sections. Preferably ordered packings are used as mass transfer elements—mainly in the crude argon column and semipure column. However, portions of the columns may also be equipped with conventional rectifying plates.

In the concrete example of the drawing, the crude argon column has one rectifying section; the semipure column has three. However, the number of these sections may vary. In the crude argon column it may vary from one to approximately three; in the semipure column, approximately from two to six.

The crude argon column 5 contains, for example, 30 to 120, preferably approximately 60 to 90 theoretical plates. The number of theoretical plates in the semipure column 9 amounts to, for example, 60 to 150, preferably approximately 90 to 120. The ratio of the theoretical plate numbers (crude argon column 5 to semipure column 9) is, for example, 0.5.

In the different flows, the oxygen concentrations have, for example, the following values:

Transition fraction 4—82% to 92%, preferably approximately 86% to 90%

Crude argon fraction 6—0.7% to 2.0%, preferably approximately 0.5% to 3.0%

Argon fraction 10—0.01 ppm to 10 ppm, preferably approximately 0.01 ppm to 0.1 ppm.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A process for extracting argon from air using a rectifying system including an air separating column, a crude argon column, and a semipure column, said process comprising:

extracting an argon-containing oxygen fraction from the air separating column and introducing same to the crude argon column, extracting a crude argon fraction from an upper area of the crude argon column, charging an upper area of the crude argon column with a first reflux liquid, extracting a first residual fraction from a lower area of the crude argon column, introducing the crude argon fraction to a lower area of the semipure column, extracting an argon fraction which is reduced in oxygen from an upper area of the semipure column, charging an upper area of the semipure column with a second reflux liquid, and extracting a second residual fraction from a lower area of the semipure column, said second residual fraction forming the first reflux liquid for the crude argon column.

2. A process according to claim 1, comprising maintaining the pressure in the lower area of the semipure column essentially identical to the pressure in the upper area of the crude argon column.

3. A process according to claim 1, comprising condensing at least a portion of the argon fraction from an upper area of the semipure column by an indirect heat exchange, wherein at least a portion of the condensate forms the second reflux liquid.

4. A process according to claim 2, comprising condensing at least a portion of the argon fraction from an upper area of the semipure column by an indirect heat exchange, wherein at least a portion of the condensate forms the second reflux liquid.

5. A process according to claim 3, comprising evaporating a liquid fraction from a phase of the air separating column during the indirect heat exchange.

6. A process according to claim 5, wherein the air separating column is constructed as a double column and comprises a pressure column and a low pressure column, the argon-containing oxygen fraction being taken from the low-pressure column, the liquid fraction which evaporates against condensing argon fraction being formed by oxygenenriched liquid from the pressure column, and the evaporated liquid fraction being fed into the low-pressure column.

7. A process according to claim 1, wherein the crude argon column has filling bodies and/or ordered packings.

8. A process according to claim 6, wherein the crude argon column contains non-structured and/or structured packings.

9. A process according to claim 1, wherein the semipure column contains non-structured and/or structured packings.

10. A process according to claim 1, wherein the semipure column contains non-structured and/or structured packings.

11. An apparatus for extracting argon from air, comprising a rectifying system which includes at least one air separating column, one crude argon column, and a semipure column, wherein the air separating column and the crude argon column are connected by way of a line for an argon-containing oxygen fraction, wherein a crude argon line extends from an upper area of the crude argon column into a lower area of the semipure column, wherein means are provided for the feeding of reflux fluid into upper areas of the crude argon column and the semipure column, and wherein residual fraction lines are provided which each lead out of lower areas of the crude argon column and the semipure column, the residual fraction line of the semipure column being connected with the means for the feeding of reflux fluid into the crude argon column.

12. Apparatus according to claim 11, wherein the crude argon line is without any means for reducing or increasing the pressure.

13. Apparatus according to claim 11, comprising a head condenser, with a condensation side connected with the upper area of the semipure column.

14. Apparatus according to claim 12, comprising a head condenser, with a condensation side connected with the upper area of the semipure column.

15. Apparatus according to claim 13, wherein a liquid line extends from the air separating column to an evaporation side of the head condenser.

16. Apparatus according to claim 14, wherein a liquid line extends from the air separating column to an evaporation side of the head condenser.

17. Apparatus according to claim 11, wherein the crude argon column contains non-structured and/or structured packings.

18. Apparatus according to claim 16, wherein the crude argon column contains non-structured and/or structured packings.

19. Apparatus according to claim 11, wherein the semipure column contains non-structured and/or structured packings.

20. Apparatus according to claim 16, wherein the semipure column contains non-structured and/or structured packings.

21. Apparatus according to claim 17, wherein the semipure column contains non-structured and/or structured packings.

* * * * *